US005687957A

United States Patent [19]

Finkelstein

[11] Patent Number: 5,687,957

[45] Date of Patent: Nov. 18, 1997

[54] FENCE SLAT INSTALLATION AND CONSTRUCTION

[75] Inventor: Harvey Finkelstein, Washington Township, N.J.

[73] Assignee: Tri-Seal International, Inc., Blauvelt, N.Y.

[21] Appl. No.: 667,034

[22] Filed: Jun. 19, 1996

[51] Int. Cl.[6] ..... B21F 27/00

[52] U.S. Cl. ..... 256/34; 256/32

[58] Field of Search ..... 256/34, 32, 35, 256/45, 47

[56] References Cited

U.S. PATENT DOCUMENTS

| | | | |
|---|---|---|---|
| 3,712,590 | 1/1973 | Tochner et al. . | |
| 3,958,794 | 5/1976 | Suprunuk et al. . | |
| 4,085,954 | 4/1978 | Thompson . | |
| 4,723,761 | 2/1988 | Cluff . | |
| 4,860,998 | 8/1989 | Snyder | 256/34 |
| 5,007,619 | 4/1991 | Sibeni | 256/34 |
| 5,165,664 | 11/1992 | Cluff . | |
| 5,184,801 | 2/1993 | Finlelstein . | |
| 5,275,380 | 1/1994 | Barsby . | |
| 5,275,381 | 1/1994 | Cluff et al. . | |
| 5,482,256 | 1/1996 | Caron | 256/35 X |
| 5,584,468 | 12/1996 | Meglino et al. | 256/32 X |

*Primary Examiner*—Harry C. Kim
*Assistant Examiner*—William L. Miller
*Attorney, Agent, or Firm*—Lowe, Price, LeBlanc & Becker

[57] ABSTRACT

A slat apparatus for use with a chain link fence for providing privacy, wind protection and/or decoration includes a plurality of slat members for positioning in slat receiving channels formed by linking wires of the fence. Each slat member includes a substantially rigid elongated hollow body member having curved side members, at least a pair of curved longitudinal ribs therein and a pair of flexible and resilient wing portions positioned on opposite sides thereof. The ribs in the rigid elongated body member prevents crimping of the fence slat when installed in a chain link fence.

17 Claims, 2 Drawing Sheets

FENCE SLAT INSTALLATION AND CONSTRUCTION

FIELD OF THE INVENTION

The present invention is directed to the installation and construction of fence slats and, in particular, to a reinforced fence slat construction which prevents crimping during installation.

BACKGROUND ART

It is well known in the prior art to use fence slats with chain link fences for privacy, wind protection and/or decoration.

U.S. Pat. No. 5,184,801 to Finkelstein discloses a winged fence slat construction. The winged fence slats have a substantially rigid elongated body member and a pair of flexible and resilient wing portions. The combined width of the wing portions is approximately equal to or greater than the width of the body member to enable easy installation of the slats and to provide complete privacy in a neat and uniform manner. The wing portions can also have transverse cuts therein to increase the flexibility thereof. The flexible wing portions permit the winged fence slats to slide past knuckles of the chain link fence during installation.

During installation of the winged fence slats described above, the winged portions brush past the chain link fence knuckles when the fence slats are inserted therein. Occasionally, the knuckles may interfere with the fence slat insertion and cause the winged fence slat to crimp.

Referring now to FIG. 1, a prior art fence slat is shown with a crimp therein. The prior art slat is generally designated by reference numeral 10 and is seen to include a hollow elongated body 1 and a pair of winged portions 3*a* and 3*b*. Each of the winged portions 3*a* and 3*b* has transverse cuts 5 therein. The cuts define a plurality of substantially position maintaining wing members 7. During installation of these prior art fence slats, a crimp 9 can form when one or more of the wing members 7 catch on one of the knuckles of the chain link fence.

As such, a need has developed to provide an improved fence slat construction which overcomes the problem of the prior art fence slats described above.

In response to this need, the present invention provides an improved fence slat installation and method which eliminates crimping during fence slat installation.

In the prior art, fence slats have been proposed for use with chain link fences wherein the fence slats include legs to eliminate rattling and prevent the slat from slipping loose of the fence. U.S. Pat. No. 3,712,530 to Tochner et al. discloses this type of fence slat. This patent also discloses alternative slat configurations including generally rectangular shapes. The length of the rectangular slat corresponds to the wide dimension of the chain link fence channel with the overall thickness corresponding to the narrow dimension of the channel. Thus, a snug fit is achieved so as to prevent rattling or slipping of the slat. The rectangular slats can also have a hollow tubular core structure or a central leg for improved rigidity.

The Tochner et al. patent does not recognize the problem of crimping during fence slat installation and does not teach a solution thereto.

U.S. Pat. No. 4,085,954 to Thomson discloses a slat assembly for chain link fence. The slats of this patent are formed with a flat front surface reinforced for structural strength with a plurality of rearwardly extending laterally spaced ribs, the ribs perpendicular to the longitudinal axis of the slat.

U.S. Pat. No. 5,275,380 to Barsby discloses an improved slat which has a corrugated slat shape which provides substantial flexibility in the slat lateral width for installation purposes.

None of the aforementioned patents teach or fairly suggest overcoming the problem of installing winged fence slats without crimping the slat.

SUMMARY OF THE INVENTION

Accordingly, it is a first object of the present invention to provide a method for installing winged fence slats which eliminates fence slat crimping.

Another object of the present invention is to provide an improved winged fence slat construction.

A further object of the present invention is to provide a fence slat installation and construction which utilizes longitudinal ribs in the elongated hollow body of the winged fence slat.

Other objects and advantages of the present invention will become apparent as a description thereof proceeds.

In satisfaction of the foregoing objects and advantages, the present invention provides a fence slat construction for fences of the type having linking wires which form holes and define a plurality of slat receiving channels therebetween. The improved fence slat construction comprises a plurality of slat members for positioning in the slat receiving channels, respectively, each of the slat members including an elongated hollow body member and a pair of flexible and resilient wing portions of substantially the same width positioned on opposite sides of the body member. The combined width of the wing portions approximates the width of the body member and the outer ends of the wing portions are sufficiently thin so as to enable the wing portions to flex around the fence knuckles and extend beyond the slat receiving channels such that substantially no space remains between the wing portions of adjacent slat members when positioned in the slat receiving channels of the fence. The elongated hollow body has a pair of curved ribs therein, each rib extending the length of the fence slat with their respective concave surfaces facing each other.

The hollow body comprises opposing sides and opposing end portions. Each of the wing portions extend from a respective end portion.

The elongated hollow body has a thickness which varies from a maximum at shoulders formed where the respective sides meet a respective end portion to a minimum located generally at a midpoint of each side. The increased thickness shoulders provide more strength in the part of the fence slat subjected to the most resistance during slat insertion. This thickness difference results in each side having a curved shape resulting in an external concave surface.

The end portions have a concave internal surface which, when combined with the curved sides provide both resilience and strength.

The present invention also discloses a method of installing a fence slat having the wing portions as described above wherein the fence slat is inserted into the slat receiving channel of a fence of the type having linking wires without crimping the fence slat. In this method, the wing portions of the fence slat flex around the knuckles of the linking wire fence. However, the fence slat does not crimp due to the presence of the more ribs within the elongated hollow body member.

BRIEF DESCRIPTION OF THE DRAWINGS

Reference to now made to the drawings of the invention wherein.

DESCRIPTION OF THE PREFERRED EMBODIMENTS

The present invention is an improvement over the winged fence slat construction disclosed in U.S. Pat. No. 5,184,801. This patent is hereby incorporated in its entirety by reference.

According to the invention, a winged fence slat construction and method of installation is provided which eliminates or minimizes the crimping of the winged fence slat when installed in a chain link fence. Elimination of crimping is achieved by providing one or more ribs aligned longitudinally with the fence slat as a crimping prevention means.

Figure 2:
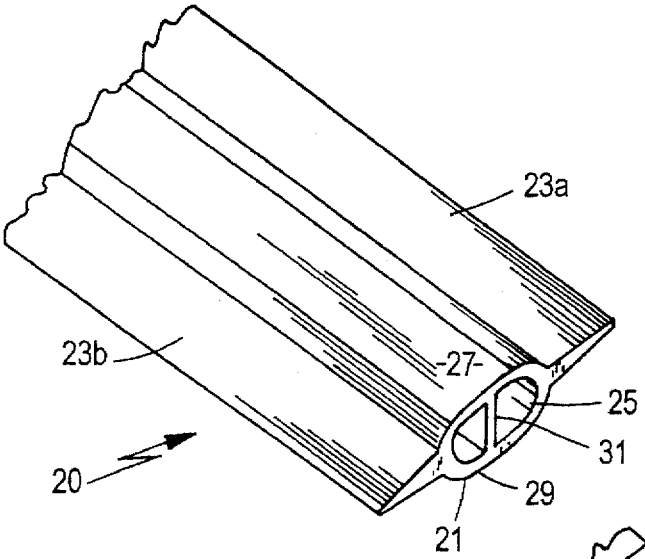
FIG. 2 is a perspective view of a first embodiment of the fence slat construction according to the invention.

With reference to FIG. 2, a first embodiment of the inventive fence slat construction is generally designated by the reference numeral 20 and is seen to include an elongated hollow body 21 and opposing wing portions 23*a* and 23*b*. The elongated hollow body 21 has a channel 25 therein. Arranged between opposing faces 27 and 29 of the body 21 is a rib 31. In this embodiment, the rib interconnects the faces 27 and 29 and is generally perpendicular to a plane intersecting the wing portions 23*a* and 23*b*. The rib 31 effectively prevents the elongated hollow body 21 from irreversibly crimping during fence slat installation.

Figure 3:
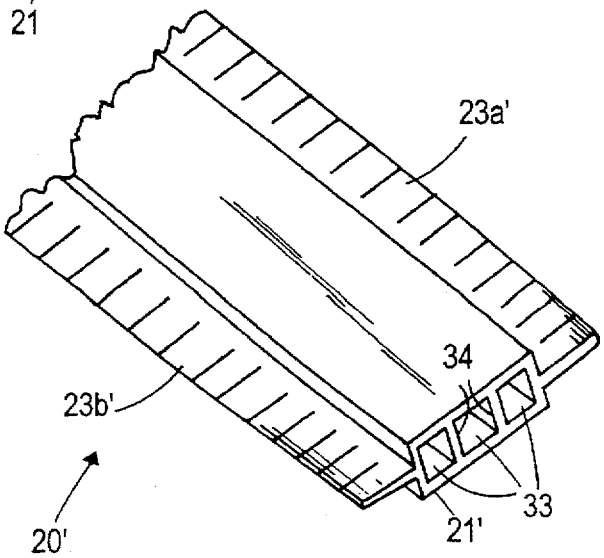
FIG. 3 is a perspective view of a second embodiment of the invention.

FIG. 3 shows a second embodiment of the invention which is generally designated as 20'. In this embodiment, the wing portions 23*a'* and 23*b'* are similar to those described in FIG. 1.

The elongated hollow body 21' has a generally rectangular configuration. The hollow body 21 is divided into three channels 33 by the ribs 34.

Figure 1:
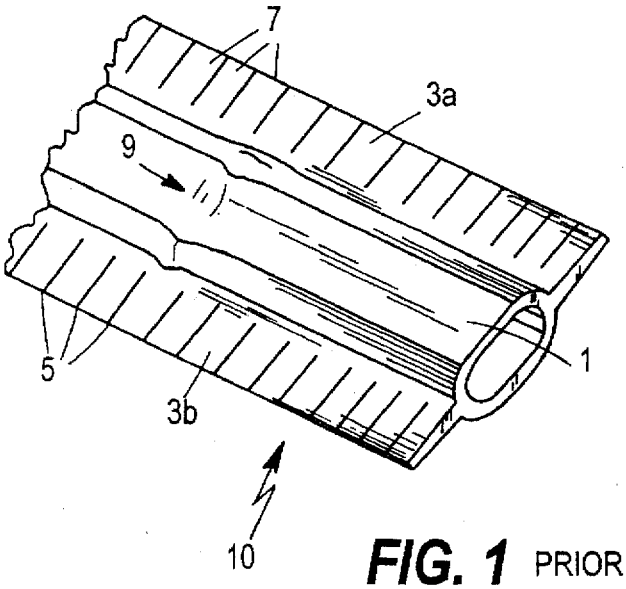
FIG. 1 PRIOR ART
FIG. 1 is a perspective view of a prior art fence slat construction.

The wing portions 23*a* and 23*b* also differ from FIG. 1 in that their cross-sectional profile is more rectangular than tapered.

The width of the fence slat may vary and will depend on the width of the chain link fence receiving channels. The width of the body 21' is preferably approximately equal to half the width of a fence channel. The body 21' also approximates the combined width of the wing portions 23*a* and 23*b*. As an example, the elongated body may have a width of approximately three-quarters of an inch with the wing portions having a width of approximately one-half inch. As another example of the body 21' approximating the wing portion widths, the body 21' is about 4 cm and the wing portions are each 1.5 cm. Of course, the wing portion widths could exceed the body width.

The fence slat can be made of any suitable material with a preferred material being a high density polyethylene or other polymer material. Alternatively, the elongated body can be one material with wing portions being another material. For example, the body may be high density polyethylene with the wing portions being made of a mixture of polyethylene and ethyl vinyl acetate.

The fence slat can be made by any known process with a preferred method including an extrusion process. When making the elongated body and the wing portions of different materials, a co-extrusion process can be utilized.

Figure 4:
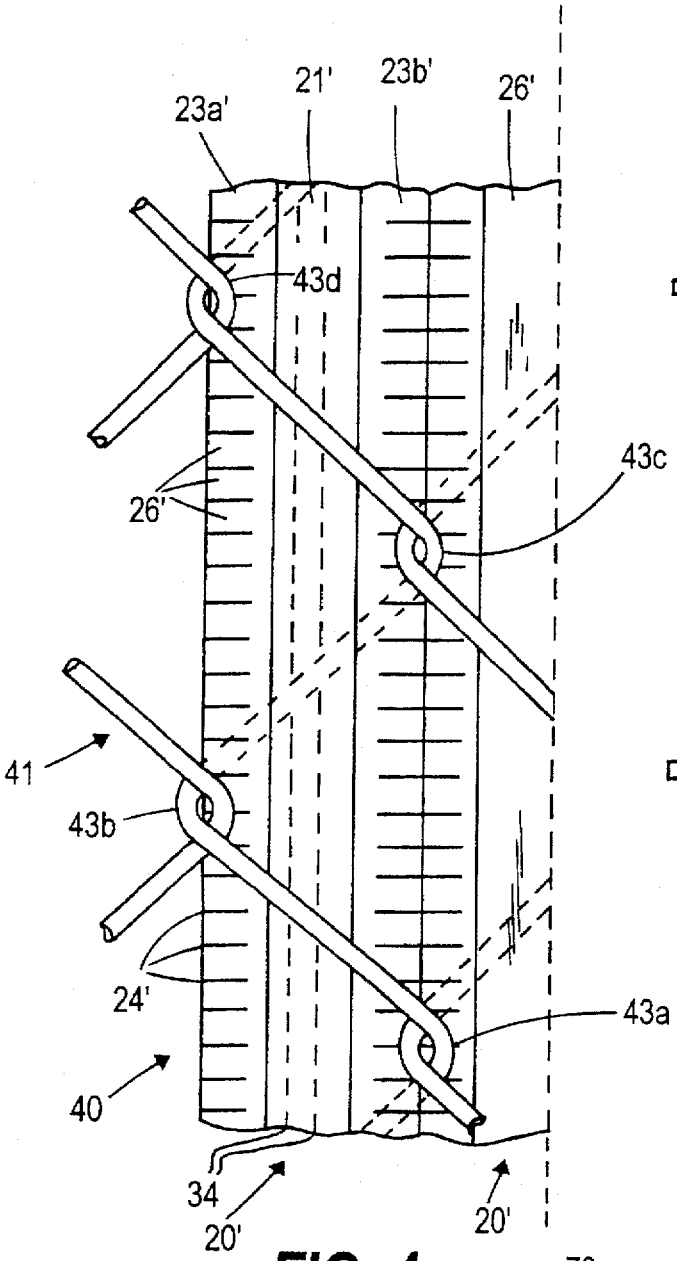
FIG. 4 an elevational view of one embodiment of the inventive fence slat installed in a chain link fence.

Referring now to FIG. 4, an exemplary installation is represented by the reference numeral 40. In this figure, a slat 20' with wing portions 23*a'* and 23*b'* is inserted into a channel of the chain link fence 41 with a portion of an adjacent slat 21' also depicted. The channel is defined by the knuckles 43*a*–43*d*.

According to the method aspect of the invention, the slat 20' is slid between the knuckles 43*a*–43*d*. The wings 23*a'* and 23*b'* slide past the knuckles by virtue of the wing members 26' formed by the cuts 24'. Any catching of the members 26' on the knuckles does not crimp the body 21' since the ribs 34 forming part of the body 21' provide sufficient crimping prevention rigidity. With the ribs 34 in place, the fence slat 20' can be easily inserted into the channel formed by the linking wires of the chain link fence 41.

Figure 5:
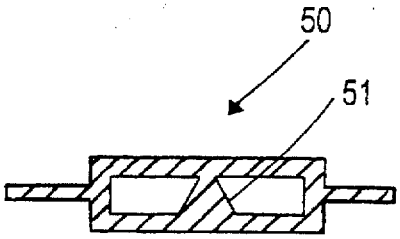
FIG. 5 is cross-sectional view of a third embodiment of the inventive fence slat construction.
Figure 6:
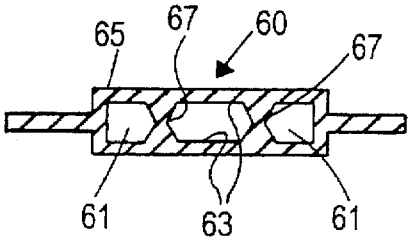
FIG. 6 is a cross-sectional view of a fourth embodiment of the invention.

Referring to FIGS. 5 and 6, alternative rib arrangements are designated by the reference numerals 50 and 60. In FIG. 5, the cross-sectional shape of the rib 51 is triangular. In FIG. 6, the ribs 61 taper from an inner surface 63 of the body 65 toward a portion of reduced thickness 67. In these embodiments, the enlarged cross-sectional area contributes to improved resistance to crimping during the installation of the fence slats described above.

Although one or two ribs have been depicted in the embodiments discussed above, more than two ribs can be utilized if additional resistance to crimping is needed. The ribs can be spaced apart to provide areas within the elongated hollow body member which are approximately equal in cross-sectional areas or, alternatively, uneven sections, if desired.

Figure 7:
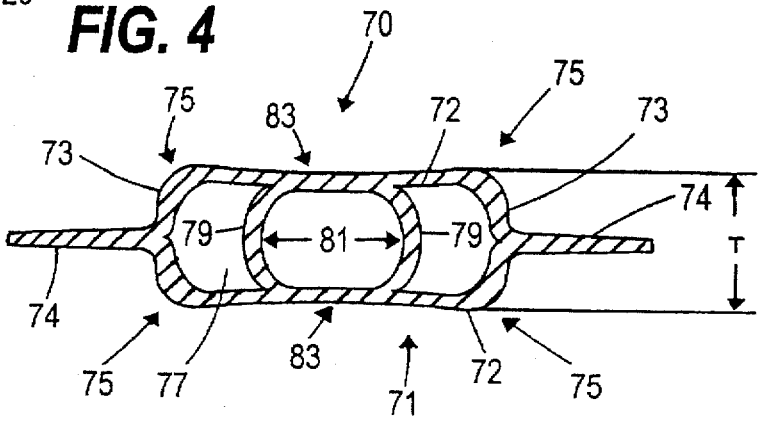
FIG. 7 is a cross-sectional view of a fifth embodiment of the invention.

Referring now to FIG. 7, a fifth embodiment of the invention is generally designated by the reference numeral 70. This embodiment shows an alternative to the embodiments depicted in FIGS. 2–6 wherein the FIG. 7 fence slat has a combination of high strength for fence slat insertion with high resiliency. The region of high strength is concentrated in the elongated body member in a region near the wing portions so that when the wing portions engage the fence knuckles, the region of high strength prevents crimping. In combination with the high strength regions, the fence slat is configured to provide a more resilient portion. This embodiment is ideally suited for fence slat insertion.

Referring again to FIG. 7, the fence slat 70 has an elongated body member 71 which includes opposing sides 72 and opposing end portions 73. Wing portions 74 extend laterally from the end portions 73.

The side portions 72 join the respective end portions at shoulder pairs 75. The shoulders 75 provide the increased strength noted above.

The opposing ends 72 are slightly curved in shape so as to form an external concave surface 83. By reason of the concave surfaces 83, the thickness of the elongated body member 71 at a mid point of the sides 72 is less than the thickness of the body member when measured at the shoulders 75, this thickness represented by the letter "T". The increased thickness of the shoulders contributes to the improved strength in this region to facilitate fence slat insertion without slat crimping.

The embodiment depicted in FIG. 7 also includes a pair of curved ribs 79 disposed within the hollow 77 of the elongated body member 71. The curved ribs 79 each have a concave surface 81, the concave surfaces 81 facing each other. The curved configuration of the ribs 79 contributes to the improved overall rigidity of the fence slat as well as resilience along the fence slat longitudinal axis. Since the ribs 79 are curved outwardly with reference to the fence slat longitudinal axis, the slat has improved resilience thereal-ong.

In a preferred embodiment, the thickness T is 0.275 inches±0.035 inches. The thickness of the body member at its longitudinal midpoint is about 20 mils less than this thickness. The overall width of the fence slat is 1.45 inches±0.20 inches. The wall thickness if about 0.035 inches±0.005 inches. The width of the wing 74 is 0.325 inches as measured from the junction with the end portions to the wing tip. Of course, the dimensions can vary depending on the particular fence being used. The elongated body member 71 preferably comprises high density polyethylene with the wing portions 74 preferably being made of high density polyethylene with 9% ethylene vinyl acetate.

It should be understood that the variations on the embodiments depicted in FIGS. 2–6 are equally adapted for the embodiment depicted in FIG. 7 where appropriate.

As such, an invention has been disclosed in terms of preferred embodiments thereof which fulfill each and every-one of the objects of the present invention as set forth hereinabove and provides a new and improved fence slat installation method and construction.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. Slat apparatus for use with a fence of the type having linking wires which form knuckles and define a plurality of slat receiving channels therebetween, comprising a plurality of slat members for positioning in said slat receiving channels, respectively, each of said slat members including an elongated body member having opposing sides and opposing end portions, an intersection of an end of a respective opposing side and an end of a respective opposing end portion forming a shoulder so that the elongated body member has opposing pairs of said shoulders, each pair of said shoulders having a first thickness, the elongated body member further having a pair of flexible and resilient wing portions of substantially the same width, each wing portion extending from each of said end portions of said elongated body member, wherein outer ends of said wing portions are sufficiently thin so as to enable said wing portions to flex around the fence knuckles and extend beyond said slat receiving channels such that substantially no space remains between the wing portions of the adjacent slat members when positioned in the slat receiving channels of the fence, said elongated body member being hollow and having at least two ribs therein, the ribs being curved in shape such that concave surfaces of the ribs face each other and the ribs extend the length of the elongated body member, and wherein each of said opposing sides is curved in shape so that the first thickness of each of the pairs of said shoulders is greater than a second thickness of said elongated body member at a midpoint thereof.

2. Apparatus as defined in claim 1, wherein the width of said body member is approximately half the width of the slat receiving channel.

3. Apparatus as defined in claim 1, wherein said wing portions have substantially transverse cuts therein defining a plurality of substantially position maintaining wing members to increase the flexibility of said wing portions.

4. Apparatus as defined in claim 1, wherein the combined width of said wing portions is greater than the width of said elongated body member.

5. Apparatus as defined in claim 1, wherein said elongated body member and said wing portions are integrally formed of plastic materials.

6. Apparatus as defined in claim 5, wherein said elongated body member and said wing portions are co-extruded from different plastic materials.

7. Apparatus as defined in claim 1, wherein said elongated body member is made of high density polyethylene.

8. Apparatus as defined in claim 1, wherein said wing portions are made of a mixture of polyethylene and ethyl vinyl acetate.

9. Apparatus as defined in claim 3, wherein said transverse cuts are provided approximately every one-quarter of an inch along the length of said wing portions.

10. Apparatus as defined in claim 3, wherein said transverse cuts extend only partially through the width of said wing portions.

11. The apparatus of claim 1, wherein each of said end portions has an internal generally concave surface.

12. The apparatus of claim 1, wherein the ribs are disposed symmetrically about a longitudinal axis of said elongated body member.

13. The apparatus of claim 1, wherein each said pair of said shoulders provides a high strength region of said slat member with said ribs and said opposing sides forming a resilient region of said slat member.

14. The apparatus of claim 1, wherein each said pair of said shoulders are rounded in shape.

15. The apparatus of claim 1, wherein said first thickness is about 0.275 inches and said second thickness is about 20 mils less than said first thickness.

16. A method of inserting a fence slat into a fence without said fence slat crimping comprising the steps of:

a) providing the fence with linking wires which form knuckles and define a plurality of slat receiving channels therebetween;

b) providing a plurality of slat members for positioning in said slat receiving channels, each of said slat members including an elongated body member having opposing sides and opposing end portions, an intersection of an end of a respective opposing side and an end of a respective opposing end portion forming a shoulder so that the elongated body member has opposing pairs of said shoulders, each pair of said shoulders having a first thickness, the elongated body member further having a pair of flexible and resilient wing portions of substantially the same width, each of said wing portions extending from each of said end portions of said elongated body member, wherein outer ends of said wing portions are sufficiently thin so as to enable said wing portions to flex around the fence knuckles and extend beyond said slat receiving channels such that substantially no space remains between the wing portions of the adjacent slat members when positioned in the slat receiving channels of the fence, said elongated body member being hollow and having at least two ribs therein, the ribs extending the length of the elongated body member and being curved in shape such that concave surfaces of the ribs face each other, wherein each of said opposing sides is curved in shape so that the first thickness of the pairs of said shoulders is greater than a second thickness of said elongated body member at a midpoint thereof; and c) sliding said slat members into a respective said slat receiving channel without each said slat member crimping due to said at least two ribs in said elongated body member.

17. The method of claim 16 wherein said step b) further comprises providing each said wing portion with substantially transverse cuts therein to define a substantially position maintaining wing member to increase flexibility.

* * * * *